United States Patent [19]

King

[11] 4,306,463

[45] Dec. 22, 1981

[54] LONG STROKE PUMP JACK

[76] Inventor: Gerald R. King, 1004 W. 10th St., Tyler, Tex. 75701

[21] Appl. No.: 144,204

[22] Filed: Apr. 28, 1980

[51] Int. Cl.[3] ..... F16H 21/54

[52] U.S. Cl. ..... 74/99 R; 74/41; 74/96; 74/110; 74/590

[58] Field of Search ..... 74/41, 96, 97, 110, 74/589–591, 99 R

[56] References Cited

U.S. PATENT DOCUMENTS

| | | | |
|---|---|---|---|
| 1,293,609 | 2/1919 | Dayton . | |
| 1,359,644 | 11/1920 | Wright | 74/41 |
| 1,414,876 | 5/1922 | Hoffman | 74/41 |
| 1,472,362 | 10/1923 | Hoffman et al. | 74/41 |
| 1,507,061 | 9/1924 | Hoffman | 74/41 |
| 1,795,922 | 3/1931 | Baker . | |
| 1,891,552 | 12/1932 | McCrosky . | |
| 2,184,200 | 12/1939 | Thomas | 74/41 |
| 2,198,348 | 4/1940 | Porter | 74/41 |
| 2,432,735 | 12/1947 | Downing | 74/110 |
| 2,841,992 | 7/1958 | Chastain | 74/41 |
| 2,877,652 | 3/1959 | Muschalek | 74/41 |
| 3,175,513 | 3/1965 | Dulaney | 74/110 |
| 3,209,605 | 10/1965 | Scoggins | 74/48 |
| 3,221,568 | 12/1965 | Ross | 74/106 |
| 3,230,782 | 1/1966 | Harryman et al. | 74/41 |
| 4,051,736 | 10/1977 | Jones | 74/41 |

*Primary Examiner*—Lawrence J. Staab
*Attorney, Agent, or Firm*—Dennis T. Griggs

[57] ABSTRACT

An improved pump jack assembly for reciprocating a sucker rod in a well bore is disclosed. The pump jack assembly includes a walking beam pivotally mounted for free swinging motion on a Sampson post. The walking beam includes a fixed counterweight mounted on one end and a horsehead mounted on the opposite end. The walking beam is driven in up-and-down pumping motion by a pair of balance weights which are coupled for coordinated reciprocal movement along the walking beam. The balance weights are linked together for concurrent movement and are driven by a hydraulic cylinder mounted on the counterweight end of the walking beam. The weights are so positioned that while one weight is being raised by the hydraulic cylinder, the other weight is falling due to gravity. Thus the weights help each other and greatly reduce the power requirement. The downward stroke of each end of the walking beam is limited by saddle weights which are pivotally coupled to the walking beam on opposite sides of the Sampson post. A pedestal disposed in the path of movement of each saddle weight engages the saddle weight and limits its downward movement as the walking beam nears the limit of its downward stroke.

3 Claims, 3 Drawing Figures

LONG STROKE PUMP JACK

BACKGROUND OF THE INVENTION

1. Field of the Invention

This invention relates generally to oil field production equipment and more particularly to a pumping jack for reciprocating a sucker rod in a well bore.

2. Description of the Prior Art

In deep well pumps of the type used in oil well rigs, the pumping motion of the subsurface pumping equipment may originate at the surface of the ground, or the pumping motion may originate below the surface of the ground as the result of the application of electrical or hydraulic power to the subsurface pump. In the surface powered rig, a vertically reciprocating pump element at the bottom of the well is actuated by a walking beam at the head of the well through a long string of sucker rods. Conventional pumping units of the walking beam type have been mechanically driven through the agency of a Pittman crank and reduction gearing, and the motion produced thereby is characteristically nonuniform throughout the length of the stroke, with equal up-and-down stroke speed. Such mechanically driven units are characterized by relatively short, fast strokes. Consequently, the reduction gearing, Pittmans, bearings and shafts are subjected to severe loading and wear.

It has been determined through experience that the maximum volumetric pump efficiency at reduced power costs, together with greatly reduced wear and breakage of the equipment, are obtained with long, slow strokes of uniform velocity. Among the advantages in favor of the long, slow stroke are the following: (a) the smooth, more uniform motion of plunger and rod tends to reduce the formation of emulsions; (b) there is less tendency for gas lock within the pump; (c) the plunger travel necessary to maintain production is obtained with fewer stress reversals on sucker rods, reducing rod breakage and pumping interruptions; (d) more positive valve action and better filling of the pump on the upstroke usually results; and (e) surface equipment usually shows less wear and greater power economy.

The long, constant velocity stroke is also advantageous in the case of a well which produces substantial quantities of sand, since it greatly reduces surges and agitation at the well pump suction, which causes excessive quantities of sand to be drawn into the pump mechanism. The excessive intake of sand results in binding of the pump mechanism, which is costly and time consuming to repair.

The disadvantages of the mechanically driven, Pittman drive type pumping units may be summarized as follows: (a) the average Pittman type unit operates with a short, fast stroke, resulting in a low volumetric pump efficiency, high power consumption, and low recovery rate; (b) the crank accelerated motion sets up wave stresses within the string of rods, resulting in a pronounced whip which causes premature failure in the rods; (c) the lack of independent control over the up-and-down stroke speeds makes it impossible to meet the particular pumping requirements of a given well; and (d) there is no pause at the end of the down stroke to permit the rods to stretch out from inertia forces and then to recover, but instead, an immediate reversal of motion resulting in high peak stresses and frequent breakage in the rod string.

It has long been realized that the smooth, uniform action of hydraulic actuators is ideally suited to the requirements of oil well pumping. However, widespread use of hydraulic jacks has been limited because of their complexity and initial cost.

OBJECTS OF THE INVENTION

It is, therefore, the primary object of the present invention, to provide a hydraulically operated pumping jack assembly capable of delivering a long, constant velocity stroke at any desired speed to suit the individual requirements of a particular well.

A related object of the invention is to provide a hydraulically operated pumping jack assembly whereby the length of the hydraulic stroke is relatively short in comparison to the length of the walking beam pump jack stroke.

A further object of the invention is to provide a long stroke pump jack with all of the actuating mechanism mounted right on the walking beam with no connection to the ground or stationary point except by a flexible hydraulic hose, thereby providing a tremendous stroke.

Another object of the invention is to provide a long stroke pump jack that will bring the sucker rods to a gradual stop at the end of the downstroke, regardless of pumping speed, and pause for any desired length of time before starting on the upstroke, thereby eliminating rod whip and greatly increasing the service life of the rods and power transmission equipment.

Another object of the invention is to provide a highly efficient, long stroke pump jack with very low power requirements because of taking advantage of gravity alternatively on the driving weights.

Another object of the invention is to provide a hydraulic pumping unit that is simple and rugged in construction, having relatively light weight and good portability, lower in initial cost than a Pittman type unit of comparable capacity and stroke range, and capable of being readily serviced in the field.

Another object of the invention is to devise a long stroke pump jack whose operation will not be stressed regardless of the fluid conditions. If the well conditions radically change from a dead lift of oil and then becomes gaseous, thus radically changing the load lifted, that condition will not affect this pump jack. It will still run smoothly and easily. There is no gear box to tear up. Likewise, if the oil load turns to salt water, thus radically changing the load lifted, the unit will not be affected. It will always run smoothly and easily under any well conditions.

A further object of this invention is to provide a hydraulically driven long stroke pump jack which is not limited by Pittman type crank arms and reduction gearing apparatus, and is actuated by being forced down alternatively on each end by the same weight requirement.

SUMMARY OF THE INVENTION

The foregoing objects are achieved by a long stroke pump jack assembly in which a walking beam is driven in pivotal movement about a Sampson post by first and second balance weights which are pivotally mounted on opposite sides of the walking beam for coordinated, reciprocal movement along the length of the walking beam. The walking beam is furnished with a conventional counterweight on one end, a conventional horsehead on the other end, and is mounted for pivotal, up-and-down pumping motion on the fulcrum of a Sampson post.

One balance weight is mounted on the counterweight side of the walking beam, and another balance weight is mounted on the horsehead side of the walking beam. The first balance weight is mounted for pivotal movement from a first resting position above the walking beam near the fulcrum to a second resting position above the walking beam at a position intermediate the counterweight and fulcrum. The other balance weight is mounted for pivotal movement from a first resting position above the walking beam at a position intermediate the fulcrum and horsehead to a second resting position above the walking beam near the fulcrum. The balance weights are coupled together by a sprocket wheel and chain linkage assembly, with movement of the two balance weights being coordinated so that as one balance weight is moving toward a maximum moment arm position, the other balance weight is moving to a minimum arm position, and vice versa, so that as one weight is being raised by the hydraulic piston the other weight is falling due to gravity, and thus the weights are greatly helping each other and the power requirement is greatly reduced.

The downstroke of each end of the walking beam is limited by first and second saddle weights mounted on opposite sides of the walking beam. Each saddle weight is moveably mounted on the walking beam, preferably pivotally mounted, and engages a pedestal which is disposed in the path of its downward movement. The pedestal engages the saddle weight and limits its downward movement, thereby removing its load from the walking beam, as each end of the walking beam nears the limit of its downward stroke. This arrangement allows a pause at the end of the downstroke, thereby avoiding high peak stresses associated with immediate reversals of the motion. A relatively long stroke is obtainable with the foregoing arrangement by driving the balance weights with a power actuator which is mounted directly onto the counterweight end of the walking beam.

According to a preferred arrangement, the power actuator is a linear hydraulic actuator of the type having a cylinder and power arm mounted for extension and retraction within the cylinder in response to changes in hydraulic pressure. A support frame is rigidly attached to the counterweight end of the walking beam, and the cylinder is pivotally mounted to the support frame. The power arm is pivotally coupled to one of the balance weights, whereby the balance weight is moved through a vertical arc from a relatively short moment arm position near the fulcrum to a relatively long moment arm position between the fulcrum and the counterweight. The two balance weights are coupled together by a sprocket wheel and chain power transmission assembly, whereby movement of the balance weights is coordinated as the power arm is extended and retracted. The rate of up-and-down pumping motion is controlled indirectly by the rate of extension and retraction of the power arm.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawing.

DESCRIPTION OF THE PREFERRED EMBODIMENTS

Figure 1:
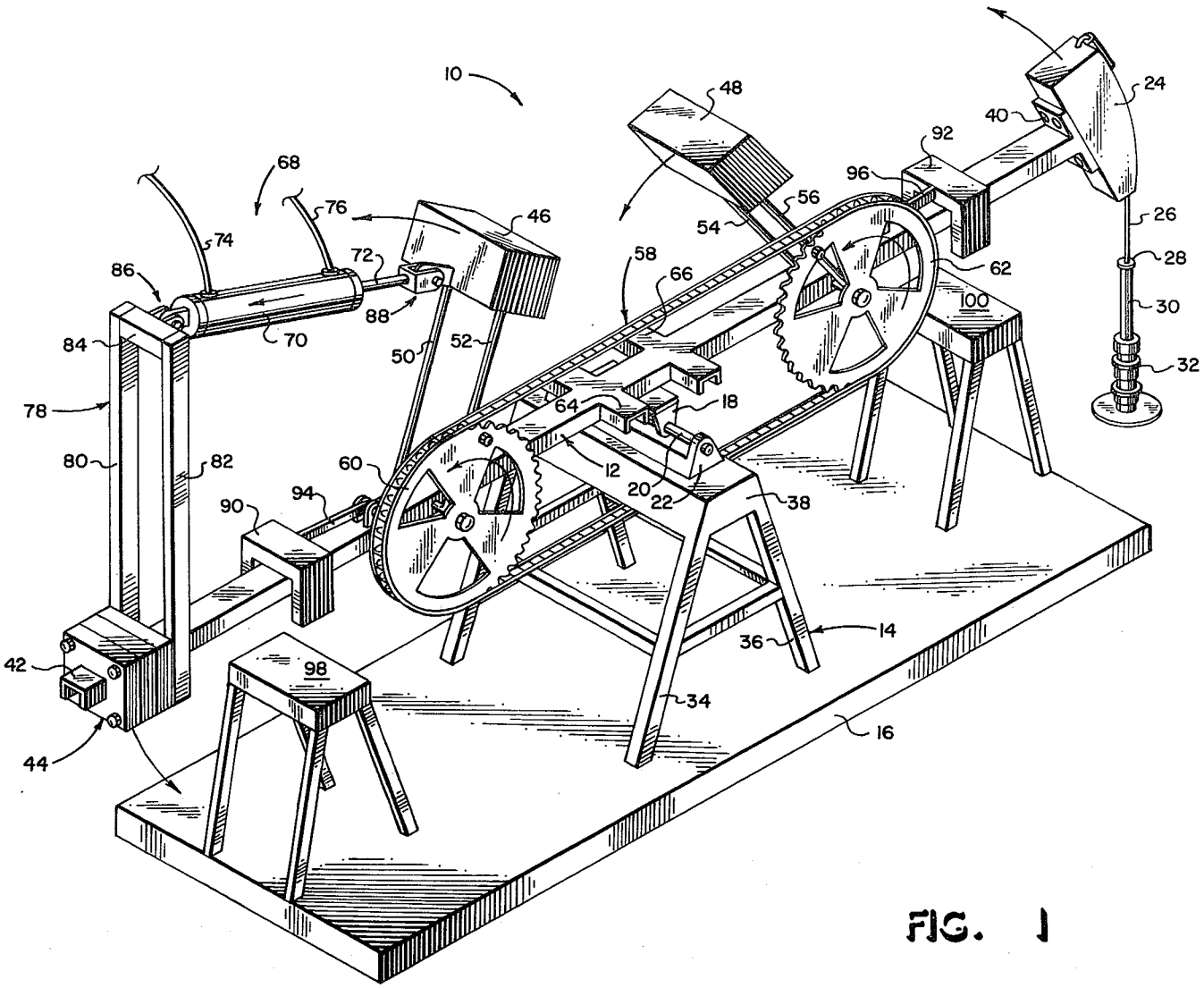
FIG. 1 is a perspective view of a long stroke pump jack which incorporates the novel features of the invention.

In the description which follows, like parts are marked throughout the specification and drawing with the same reference numerals, respectively. The drawings are not necessarily to scale and in some instances portions have been exaggerated in order to more clearly depict certain features of the invention.

Referring now to the drawings in detail and particularly to FIG. 1, a long stroke pump jack assembly 10 includes a conventional walking beam 12 pivotally mounted on a Sampson support 14. The Sampson support 14 rests upon and projects upwardly from a suitable substructure or support slab 16 which in turn rests upon the surface of the ground adjacent a well bore (not shown). The elongated walking beam 12 is secured to a saddle 18 at a point intermediate the length of the walking beam, and the saddle 18 is mounted on a shaft 20 which is journaled for pivotal movement on a fulcrum yoke 22. The walking beam 12 carries at its end adjacent the well bore a horsehead or sector head 24 which is positioned in approximate vertical alignment with the well bore.

A wireline cable 26 is anchored to the upper end of the horsehead 24, and the wireline 26 is connected through a rod clamp seat 28 to a polished rod 30 which constitutes the uppermost rod in a string of sucker rods extending downwardly into the well bore. The polished rod 30 extends through a pumping Tee 32 into production tubing (not shown) which is positioned within the well bore.

The Sampson support 14 is an A-frame structure which includes upright beams or channels 34, 36 which are commonly referred to as Sampson posts. The Sampson posts are spaced and welded to a horizontal support beam 38.

The walking beam 12 has an elongated main body which is preferably of I-beam or channel shape in transverse cross section having a support bracket 40 welded on one end and a weight support segment 42 formed on the opposite end. According to conventional practice, the horsehead 24 is attached to the support bracket 40, and a counterweight 44 is attached to the support segment 42 at the opposite end. The weight support segment 42 is an extension of the walking beam channel and is adapted to receive a plurality of the counterweights 44 as required to serve as a counter balance for the front end load including the horsehead assembly, the sucker rod load and the maximum expected formation fluid column load. It is seen, therefore, that the walking beam 12 is pivotable about the shaft 20 in an oscillatory movement to reciprocate the wireline cable 26 and sucker rod string in the usual manner. However, it will be observed that the pumping movement is imparted to the walking beam without the use of Pittman arms or gear reduction units.

According to the invention, the pumping action is controlled entirely by moving a pair of balance weights 46, 48 along the length of the walking beam 12 on opposite sides of the fulcrum 22. The balance weight 46 is supported by a pair of pivot arms 50, 52 which are pivotally mounted in suitable bearing assemblies (not shown), preferably at walking beam locations which are equidistant with respect to the fulcrum 22. The balance weight 48 is similarly coupled to the opposite side of the walking beam 12 on pivot arms 54, 56.

The balance weights 46, 48 are linked together for concurrent, coordinated movement by a sprocket chain 58. The sprocket chain 58 is engaged by sprocket wheels 60, 62 which are rigidly attached to the balance weight pivot arms 52, 56, respectively.

Figure 2:
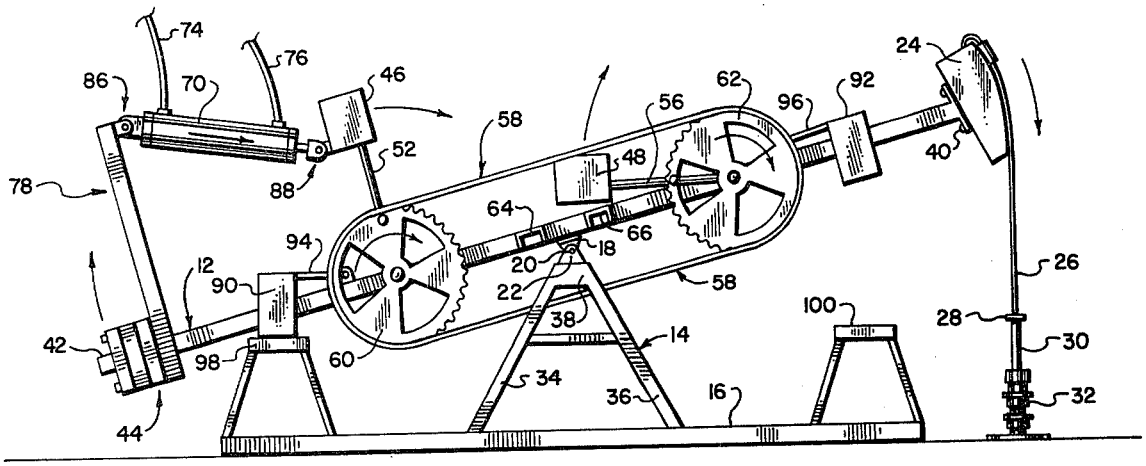
FIG. 2 is a side elevation view of the pump jack assembly which illustrates the relative positions of the balance weights as the walking beam nears the limit of the upstroke and just prior to commencement of the downstroke.
Figure 3:
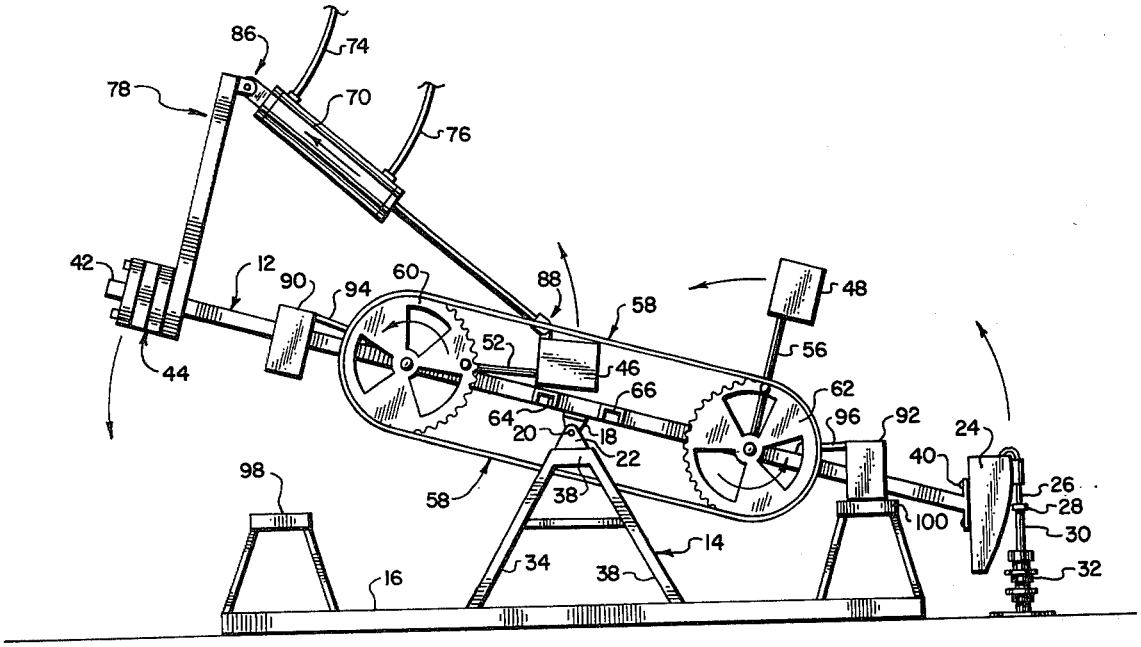
FIG. 3 is a side elevation view similar to FIG. 2 which indicates the relative position of the balance weights as the walking beam nears the limit of a downstroke, and just prior to beginning an upstroke.

According to this arrangement, the balance weight 46 is moveable through a vertical arc from a resting position overlying the walking beam near the axis of the fulcrum 22 to an upright elevated position intermediate the counterweight and fulcrum (FIG. 2). The other balance weight 48 is likewise moveable through a vertical arc from a position overlying the fulcrum axis to an upright position intermediate the fulcrum and the horsehead (FIG. 3). Movement of the balance weights 46, 48 on the upstroke is coordinated so that the first balance weight 46 reaches its most elevated, maximum moment arm position above the walking beam at the same time as the other balance weight 48 reaches its minimum moment arm position overlying the fulcrum axis (FIG. 2). Similarly, on the downstroke, as the first balance weight 46 moves toward its minimum moment arm position overlying the fulcrum axis, the other balance weight 48 moves toward its maximum moment arm position overlying the walking beam intermediate the fulcrum and the horsehead. So it can be seen that the balance weights 46, 48 help each other because as one weight is being raised, the other weight is falling due to gravity, and the power requirement is reduced considerably. Also the stress will be less on the hydraulic piston because the weight being raised will act somewhat as a brake on the weight that is falling. By shifting the balance weights relative to each other and relative to the fulcrum axis, the walking beam is driven in an up-and-down pumping motion.

Weight rest platforms 64, 66 engage the balance weights 46, 48 as they are driven to their minimum moment arm positions, respectively.

According to an important feature of the invention, the balance weights 46, 48 are driven by a linear hydraulic actuator assembly 68 which is supported entirely on the counterweight end of the walking beam 12. The linear hydraulic actuator is preferably the double acting type and includes a hydraulic cylinder 70 in which a power arm 72 is reciprocally mounted for extension and retraction in response to hydraulic pressure changes within the cyliner 70. The power arm 72 is extended by charging the cylinder through a hydraulic charge conduit 74 while simultaneously exhausting hydraulic fluid through an exhaust conduit 76. Retraction of the power arm 72 is brought about by charging the cylinder through the conduit 76 while exhausting hydraulic fluid through the conduit 74. The charge and exhaust conduits 74, 76 are flexible hydraulic lines which are connected to a hydraulic pump through a shuttle valve (not shown) in the usual manner.

The hydraulic cylinder 70 is supported above the counterweight end of the walking beam by an upright support frame 78. The support frame 78 includes upright beams 80, 82 which are rigidly fastened at their lower ends to the counterweight support segment 42. The upper ends of the upright beams are joined by a cross beam 84. The hydraulic cylinder 70 is pivotally connected to the cross beam 84 by a conventional clevis/pin coupling 86. The power arm 72 is likewise pivotally coupled to the balance weight 46 by a clevis/pin coupling 88. This arrangement allows freeswinging movement of the walking beam 12 without limitation or restriction by a Pittman arm or other power transmission apparatus which is anchored to the slab 16 or to the ground. Thus, a much larger stroke is obtainable for a walking beam of a given length and for a given horsehead radius.

The magnitude of the balance weights 46, 48 is dependent upon the length and stroke of the walking beam, the depth of the fluid in the well bore, and the density of the formation fluid which is produced. For a typical application, the column formation fluid weight to be lifted will be 3,000 pounds, and the sucker rod load will be approximately 7,000 pounds. The counterweight 44 should be approximately 8,500 pounds (the rod weight plus one-half the weight of the fluid) so that exactly the same force is required for the upstroke and the downstroke. On the downstroke there is only the weight of the rods (7,000 pounds), while on the upstroke, there is the weight of the rods plus the weight of the fluid (7,000 pounds plus 3,000 pounds). By using a counterweight of 8,500 pounds, the downstroke and the upstroke each require an identical 1,500 pound force. The 1,500 pound requirement times a 15-foot moment arm from the fulcrum to the horsehead (or to the counterbalance weight 44) is 22,500 foot pounds. Therefore, for this example, the beam length can be 30 feet long (15 feet on each side of the fulcrum. The balance weights are each 2,000 pounds and are moveable through an arc from the fulcrum axis to a position six feet from the fulcrum axis. On the upstroke, 2,000 pounds are moved forward by six feet to the fulcrum axis and 2,000 pounds are moved away from the fulcrum axis toward the counterbalance weight 44. This is a net change of 24,000 foot pounds.

Without Pittman control, or some other control means, it would be expected that the momentum of the walking beam would cause the walking beam to bump very severely at the limit of the upstroke and the downstroke, causing very severe bumping and crashing. Additionally, it would be expected that an immediate reversal of motion would result in high peak stresses and breakage in the rod string if the walking beam were allowed to reach the limit of its stroke and reverse without restraint or control. Stroke limitation and control is provided by a pair of saddle weights 90, 92 which are moveably coupled to the walking beam at locations intermediate the fulcrum and counterbalance weights, and intermediate the fulcrum and horsehead, respectively. The saddle weights 90, 92 are moveably coupled on opposite sides of the walking beam by any suitable means, but are preferably pivotally coupled by support arms 94, 96 respectively. Pedestals 98, 100 are located in the path of downward movement of the saddle weights whereby each saddle weight is engaged and lifted away from the walking beam as the walking beam nears the limit of its downward stroke. As the beam nears its stroke limit, the saddle weight on the downgoing side will engage the pedestal and ride up off the beam. When the saddle weight rides up off the beam, the beam will stop its downward travel. Assuming the saddle weights are 300 pounds and located at a moment arm of 6 feet from the fulcrum, that would remove 1,800 foot pounds of force. By placing the saddle weights relatively near the fulcrum axis, they will move more slowly and therefore engage the pedestals gently. Also an important feature of this pump jack is that it must be forced downward with exactly the same force on the downstroke as on the upstroke.

Because the balance weights assist each other as they move from their minimum and maximum moment arm positions, the hydraulic actuator 68 does not require as much force as would be required for a straight vertical lift when using a Pittman. Additionally, the Pittman requires a massive bull wheel with a relatively large radius on an eccentric which must be placed near the fulcrum axis which substantially increases the power requirement of the prime mover, especially with its short beam on a power side and long beam on a pumping side. The hydraulic actuator 68 of the pump jack assembly 10 can be operated by motor driven hydraulic pump at a substantially lower power level than would be required for a comparable Pittman drive assembly.

The rate of extension and retraction of the power arm 72 can be automatically controlled by a shuttle valve which is triggered by suitable electrical means. For example, the shuttle valve could be controlled electrically by limit switches coupled to the walking beams which are opened and closed on upstrokes and downstrokes, or by photocell arrangements in which a light beam is interrupted at the lower limit of a downstroke and at an upper limit of a pumping stroke. The electric beams or limit switches can be suitably placed to be actuated before the stroke limit to provide lead time or lag time, or a pause, as required. Also, the hydraulic pressure can be set higher or lower to actuate the hydraulic piston faster or slower depending on whether merely a pause or whether a complete stop is required at the end of each stroke.

From the foregoing description, it will be appreciated that the walking beam 12 is supported in a freeswinging arrangement and is not restricted or limited by ground-based pivot arms and the like. The prime mover is completely supported by the walking beam thereby allowing a much greater stroke range. Because of the cooperation of the balance weights, the momentum of the balance weights assists the prime mover (the linear hydraulic actuator) in driving the walking beam in up-and-down pumping motion, thereby reducing the power requirements of the prime mover. The saddle weights limit the downward travel of the walking beam, thereby eliminating the need for elaborate rotary eccentric counterbalance equipment.

Although the preferred embodiment of the invention has been described in detail, it should be understood that various changes, substitutions and alterations can be made therein without departing from the spirit and scope of the invention as defined by the appended claims.

What is claimed is:

1. A pump jack assembly comprising, in combination;

a Sampson post;

a walking beam pivotally mounted on said Sampson post, said walking beam having a fixed counterweight mounted on one end and a horsehead mounted on the opposite end;

first and second balance weights coupled to opposite sides of the walking beam, respectively, for reciprocal movement along said walking beam;

power actuator means mounted on the walking beam and coupled in driving relation with the balance weights for moving them along the walking beam;

first and second saddle weights moveably coupled to said walking beam on opposite sides of said Sampson post, respectively; and, first and second pedestals disposed in the paths of movement of the first and second saddle weights, respectively, for engaging the saddle weights and limiting their downward movement, respectively, as each end of said walking beam nears the limit of its downward stroke.

2. A pump jack comprising, in combination:

a support platform having portions defining an elevated fulcrum;

a walking beam mounted for pivotal movement on said fulcrum;

a counterweight mounted on one end of said walking beam;

a sector head mounted on the opposite end of said walking beam;

a first balance weight mounted for pivotal movement from a first resting position above said walking beam near the fulcrum to a second resting position above said walking beam at a position intermediate the counterweight and fulcrum;

a second balance weight mounted for pivotal movement from a first resting position above said walking beam at a position intermediate the fulcrum and sector head to a second resting position above said walking beam near said fulcrum;

power transmission means linking the first balance weight to the second balance weight for concurrent pivotal movement;

a hydraulic actuator having a cylinder for receiving pressurized hydraulic fluid and a power arm movable in said cylinder in extension and retraction in response to hydraulic fluid pressure changes in said cylinder, said cylinder being pivotally coupled to said walking beam and said power arm being pivotally coupled in driving relation to said first balance weight;

a first saddle weight movably coupled to said walking beam at a location intermediate the counterweight and fulcrum;

a second saddle weight movably coupled to said walking beam at a location intermediate the fulcrum and the sector head; and, first and second pedestals disposed in the paths of movement of the first and second saddle weights, respectively, for engaging the saddle weights and limiting their downward movement, respectively, as each end of said walking beam nears the limit of its downward stroke.

3. The pump jack as defined in claim 2, said power transmission means comprising a first sprocket wheel attached to said first balance weight, a second sprocket wheel attached to said second balance weight, and a sprocket chain disposed in mesh engagement with the first and second sprocket wheels.

* * * * *